US010224665B2

(12) United States Patent
Iida

(10) Patent No.: US 10,224,665 B2
(45) Date of Patent: Mar. 5, 2019

(54) CONNECTOR

(71) Applicant: Sumitomo Wiring Systems, Ltd., Yokkaichi, Mie (JP)

(72) Inventor: Masahiro Iida, Mie (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 15/973,579

(22) Filed: May 8, 2018

(65) Prior Publication Data

US 2018/0331452 A1 Nov. 15, 2018

(30) Foreign Application Priority Data

May 9, 2017 (JP) ..... 2017-093071

(51) Int. Cl.

| | |
|---|---|
| ***H01R 13/42*** | (2006.01) |
| ***H01R 13/422*** | (2006.01) |
| ***H01R 13/436*** | (2006.01) |
| ***H01R 13/426*** | (2006.01) |
| ***H01R 13/50*** | (2006.01) |

(52) U.S. Cl.

CPC ..... *H01R 13/4223* (2013.01); *H01R 13/426* (2013.01); *H01R 13/4361* (2013.01); *H01R 13/4364* (2013.01); *H01R 13/4365* (2013.01); *H01R 13/4368* (2013.01); *H01R 13/501* (2013.01)

(58) Field of Classification Search

CPC ..... H01R 13/501; H01R 13/4223; H01R 13/4261; H01R 13/4264; H01R 13/4265; H01R 13/4268

See application file for complete search history.

(56) References Cited

U.S. PATENT DOCUMENTS

| | | | | |
|---|---|---|---|---|
| 4,946,398 A * | 8/1990 | Takenouchi | ..... | H01R 13/4368 439/595 |
| 5,120,269 A * | 6/1992 | Endo | ..... | H01R 13/4368 439/595 |
| 5,292,262 A * | 3/1994 | Endo | ..... | H01R 13/4223 439/595 |
| 5,316,504 A * | 5/1994 | Jinno | ..... | H01R 13/4362 439/595 |
| 5,435,758 A * | 7/1995 | Sasai | ..... | H01R 13/4368 439/752 |

(Continued)

FOREIGN PATENT DOCUMENTS

JP 2002-184506 6/2002

*Primary Examiner* — James Harvey

(74) *Attorney, Agent, or Firm* — Gerald E. Hespos; Michael J. Porco; Matthew T. Hespos

(57) ABSTRACT

A connector includes a housing (10) having cavities (13) and deflectable and deformable locking lances (15) project into the cavities (13), and a front retainer (60) to be mounted into the housing (10) from the front. A terminal fitting (50) is inserted into the cavity (13) of the housing (10), and the locking lance (15) resiliently locks a lance receiving portion (54) so that rearward detachment of the terminal fitting (50) is restricted. The front retainer (60) includes a deflection restricting portion (77) configured to restrict the deflection of the locking lances (15), and a retaining portion (69) configured to lock retainer receiving portions (55) and retain the terminal fittings (50) by laterally approaching the terminal fittings (50) by a tilting displacement about a hinge (68) from an opening state to a closing state.

8 Claims, 14 Drawing Sheets

(56) References Cited

U.S. PATENT DOCUMENTS

| | | | | | |
|---|---|---|---|---|---|
| 5,567,184 | A * | 10/1996 | Sasai | H01R 13/4362 | 439/752 |
| 5,803,773 | A * | 9/1998 | Kashiyama | H01R 13/4368 | 439/752 |
| 5,827,093 | A * | 10/1998 | Okabe | H01R 13/506 | 439/752 |
| 6,106,340 | A * | 8/2000 | Myer | H01R 13/4367 | 439/595 |
| 7,563,135 | B2 * | 7/2009 | Takahashi | H01R 13/4362 | 439/488 |
| 9,070,999 | B2 * | 6/2015 | Endo | H01R 13/506 | |

* cited by examiner

CONNECTOR

BACKGROUND

Field of the Invention

The present invention relates to a connector.

Description of the Related Art

Japanese Unexamined Patent Publication No. 2002-184506 discloses a connector with a housing having a cavity to accommodate a terminal fitting. A retainer is connected to the housing by an integral hinge and can tilt relative to the housing. A deflectable locking lance projects from an inner wall of the cavity of the housing. The terminal fitting includes a tubular connecting portion, and a lance receiving portion is open in a peripheral wall of the connecting portion. The rear end of the connecting portion serves as a retainer receiving portion. The locking lance locks the lance receiving portion of the terminal that has been inserted in the cavity to prevent the terminal fitting from coming rearward out of the cavity. Further, the retainer can close an entrance opening of the housing, and a lock of the retainer locks a rear end edge of the connecting portion to retain the terminal fitting.

If a connector is reduced in size, a locking lance also is reduced in size to reduce a holding force for a terminal fitting. Thus, a new locking structure for suppressing deflection of the locking lance may be required. Further, if the connector is reduced in size and the structure of a housing becomes complicated, a retainer cannot be made integral to the housing.

The invention was completed on the basis of the above situation and aims to provide a connector capable of retaining a terminal fitting by a relatively simple structure.

SUMMARY

The invention relates to a connector that comprises at least one cavity capable of accommodating a terminal fitting. The terminal fitting includes a terminal body, a lance receiving portion and a retainer receiving portion provided on the terminal body. A deflectable and deformable locking lance projects into the cavity and is configured to lock the lance receiving portion and to restrict detachment of the terminal fitting. A front retainer is mounted to the housing substantially from the front and includes at least one deflection restricting portion configured to restrict deflection of the locking lance by entering a deflection space for the locking lance. The retainer also has a retaining portion configured to lock the retainer receiving portion of the terminal fitting and to retain the terminal fitting. The retaining portion is displaceable about a hinge from an opening state to a closing state and approaches the terminal fitting in a lateral direction intersecting a front-rear direction.

The housing may comprise inner and outer housings. The inner housing includes the cavity and is configured so that the front retainer is mounted thereto. The outer housing is separate from the inner housing is located outward of the inner housing. The outer housing may include a lock arm capable of holding a mating housing as a connection partner in a connected state.

The inner housing may have at least one entrance opening penetrating from an outer surface to the cavity and allowing the entrance of a locking body of the retaining portion. At least one seal ring may be fit behind the entrance opening and may be sandwiched between the inner housing and a mating housing in a fluid- or liquid-tight manner.

The inner housing is separate from the outer housing that has the lock arm. Thus, the inner housing can have a relatively simple structure and can deal with size reduction. On the other hand, the inner housing is structured such that the seal ring is fit behind the entrance opening. Accordingly, there is no marginal space to provide an integral retaining portion. Therefore, a merit of providing the front retainer with the retaining portion is large.

The retaining portion may be provided on the substantially the same side as the deflection restricting portion and may be arranged to be able to face the deflected and deformed locking lance in the opening state. If the terminal fitting is left without being properly inserted into the cavity (incompletely inserted state), the locking lance is kept deflected and deformed. In this case, a conventional front retainer can detect that the locking lance is deflected and deformed due to the interference of a deflection restricting portion with the locking lance. However, the locking lance may be fractured or broken if the deflection restricting portion strongly interferes with the locking lance. In that respect, according to the above configuration, the retaining portion in the opening state lightly interferes with the deflected and deformed locking lance earlier than the deflection restricting portion. Thus, it can be detected in an early stage that the locking lance is deflected and deformed.

The deflection restricting portion may be thicker than the hinge. Accordingly, the deflection restricting portion is strong and can reinforce deflection strength of the hinge.

The retaining portion may include locks on both side surfaces of a locking body, and the locks may engage lock receiving portions on both side walls of the front retainer in the closing state. Accordingly, the retaining portion can stably maintain the closing state.

A seal ring may be fit on the housing and may be sandwiched between the housing and a mating housing as a connection partner in a fluid- or liquid-tight manner. The retaining portion may be arranged to contact a front end of the seal ring in the closed state. Accordingly, the retaining portion prevents forward detachment of the seal ring.

The housing is an assembly of an inner housing and an outer housing. The inner housing includes the cavity and has the front retainer mounted thereto. The outer housing is separate from the inner housing and is located, at least partly, radially outward of the inner housing.

The front retainer includes the deflection restricting portion configured to restrict deflection of the locking lance and the retaining portion. A tilting movement of the retaining portion about the hinge from the opening state to the closing state laterally locks the retaining portion to the retainer receiving portion and retains the terminal fittings. Thus, rearward detachment of the terminal fitting can be reliably prevented. Further, it is not necessary to provide a dedicated retainer, such as a side retainer separately from the front retainer. Thus, the number of components can be reduced. Furthermore, the provision of the front retainer with the retaining portion makes the structure of the housing less complicated.

These and other objects, features and advantages of the invention will become more apparent upon reading the following detailed description and accompanying drawings. It should be understood that even though embodiments are described separately, single features may be combined to additional embodiments.

DETAILED DESCRIPTION

DETAILED DESCRIPTION

One embodiment of the invention is described with reference to FIGS. 1 to 14. A connector of this embodiment includes a housing 10 connectable to a mating housing 90, a front retainer 60 to be mounted into the housing 10 and terminal fittings 50 to be accommodated into the housing 10. Note that, in the following description, a surface side of the housing 10 to be connected to the mating housing 90 is referred to as a front side concerning a front-rear direction, and a vertical direction is based on figures excluding FIGS. 5, 8 and 14.

Figure 2:
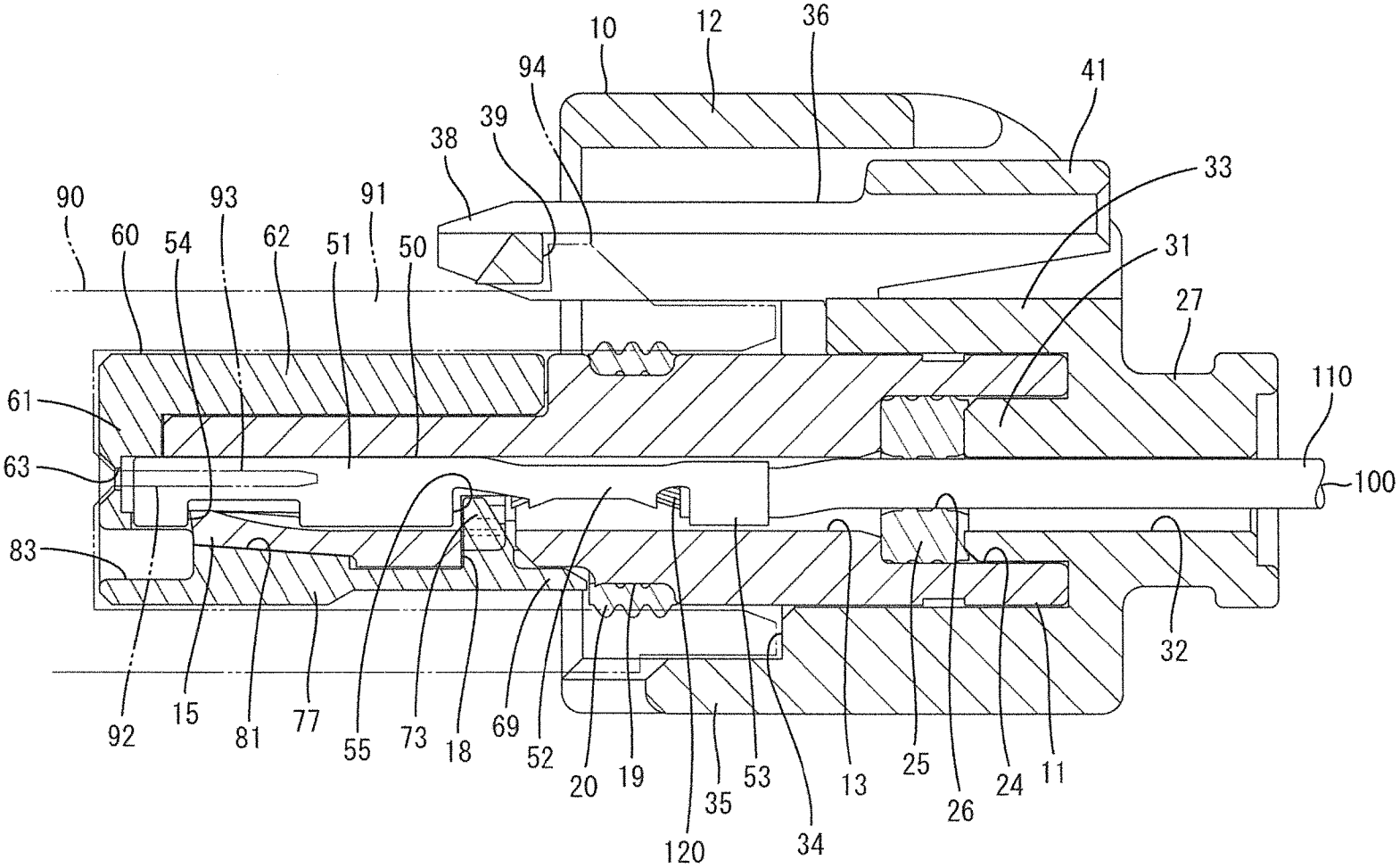
FIG. 2 is a side view in section when the front retainer is at a full locking position with respect to the housing and the retaining portion is in a closing state.

The mating housing 90 is made of synthetic resin and includes, as shown in FIG. 2, a tubular receptacle 91. Male tabs 93 of mating terminal fittings 92 are mounted on a back wall of the receptacle 91 by press-fitting or insert-molding. A plurality of (specifically two, but only one is shown) mating terminal fittings 92 are provided at positions corresponding to the terminal fittings 50, and the male tabs 93 are arranged to project into the receptacle 91. A claw-like mating lock portion 94 projects on an outer surface of an upper wall of the receptacle 91.

The housing 10 is made of synthetic resin and composed of an inner housing 11 substantially in the form of a block long in the front-rear direction and a tubular outer housing 12 separate from the inner housing 11 and arranged radially outward of the inner housing 11.

Figure 1:
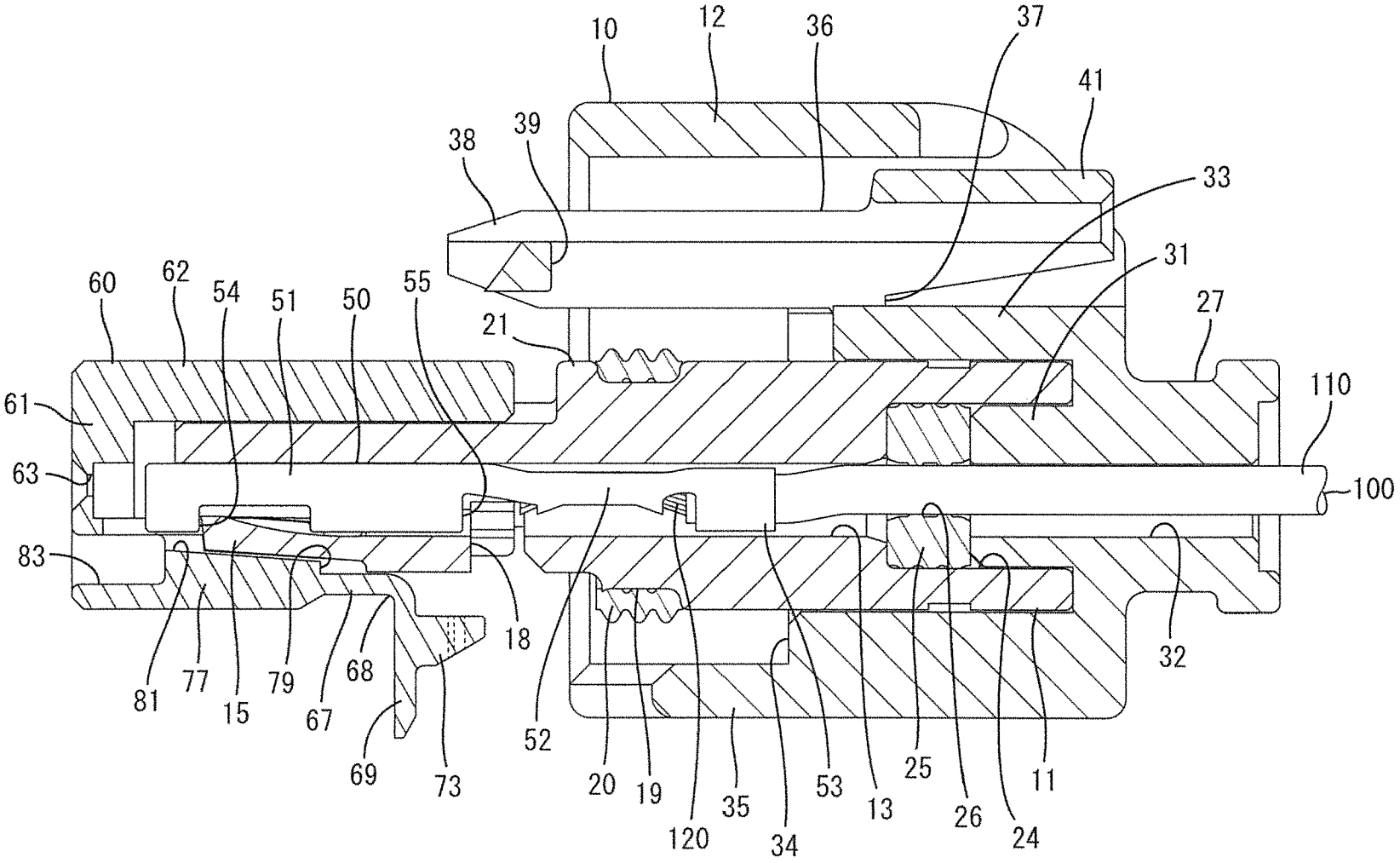
FIG. 1 is a side view in section when a front retainer is held at a partial locking position with respect to a housing and a retaining portion is in an opening state in an embodiment of the present invention.
Figure 7:
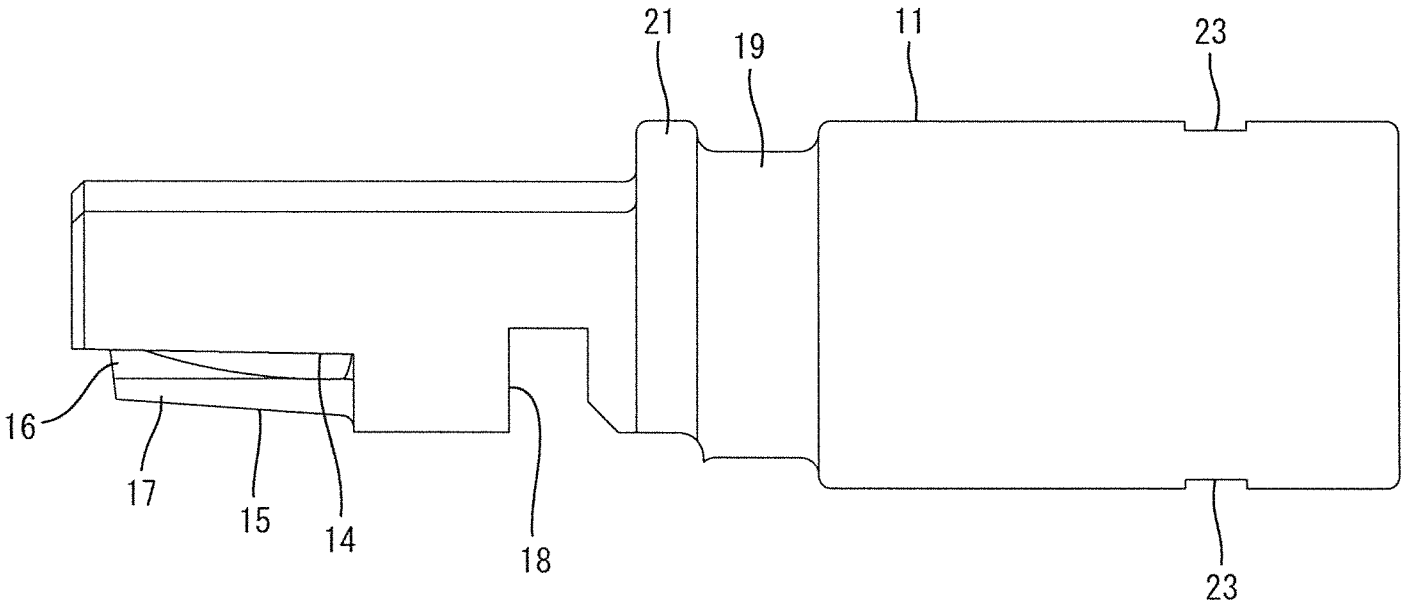
FIG. 7 is a side view of an inner housing.
Figure 8:
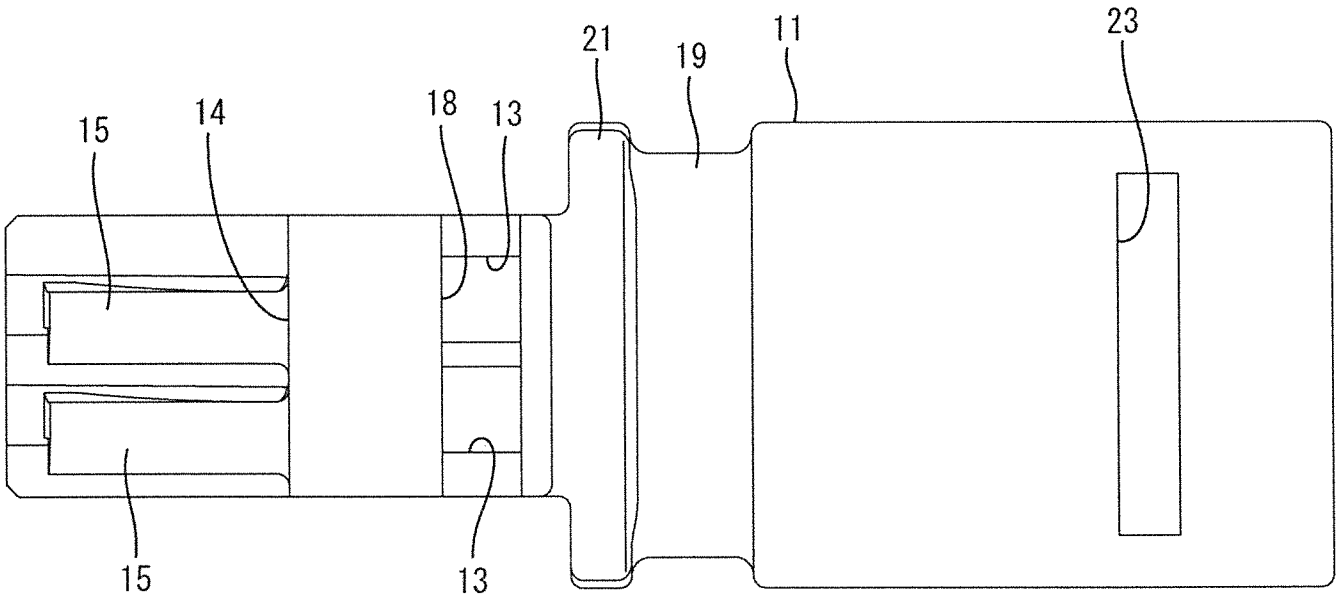
FIG. 8 is a bottom view of the inner housing.
Figure 9:
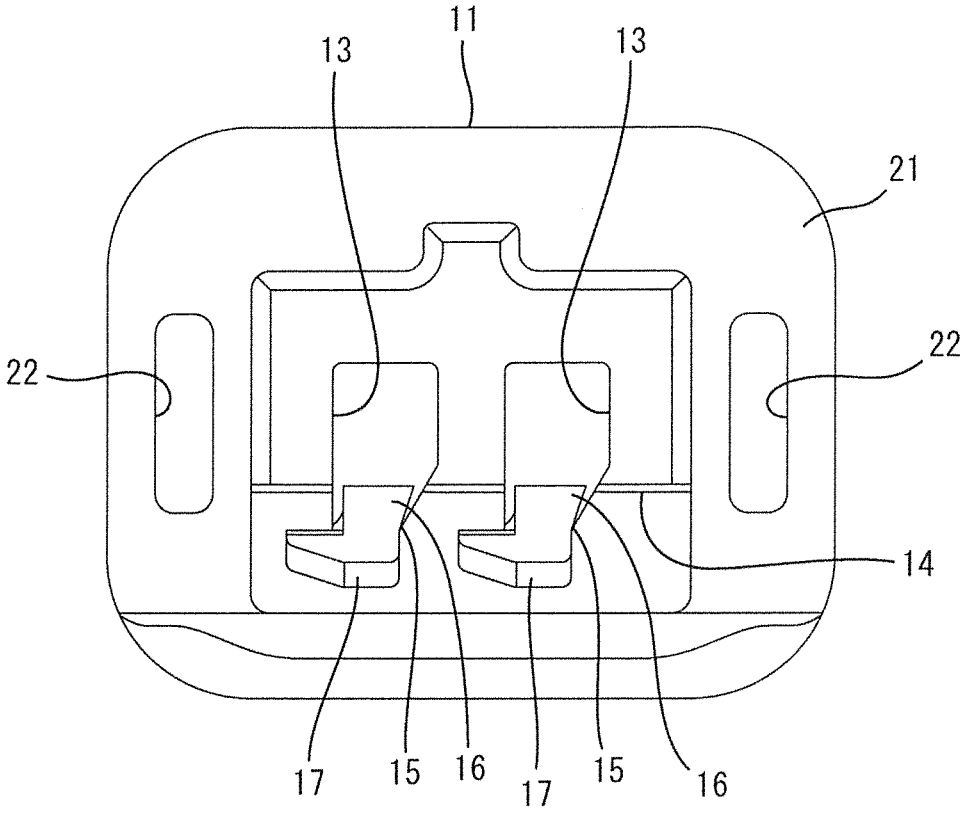
FIG. 9 is a front view of the inner housing.

As shown in FIGS. 8 and 9, the inner housing 11 is provided with a plurality of (two in a shown case) cavities 13 penetrating in the front-rear direction. As shown in FIG. 1, the terminal fittings 50 are inserted into the cavities 13 from behind. As shown in FIGS. 7 to 9, an opening 14 cut to be open in the inner housing 11 (particularly in lower and front surfaces) and communicating with each cavity 13 is provided in a lower part of a front side of the inner housing 11.

Further, the inner housing 11 includes deflectable locking lances 15 cantilevered toward the opening 14 from lower walls of the respective cavities 13. Each locking lance 15 is arranged in an exposed manner in the opening 14 and projects into the cavity 13 while being gradually inclined upward toward a front end (free end). As shown in FIG. 9, an upper part 16 of each locking lance 15 has a smaller lateral width than a lower part 17 and connected to the lower part 17 at a position deviating from a lateral center of the lower part 17 toward one side. Note that the opening 14 is a part including deflection spaces for the locking lances 15.

As shown in FIGS. 7 and 8, an entrance opening 18 open in the lower surface and both side surfaces and communicating with each cavity 13 is provided in a lower part of the inner housing 11. The entrance opening 18 is located behind each locking lance 15 and the opening 14 and formed to have a constant width in the front-rear direction. A separation wall part partitioning between the respective cavities 13 is partially cut at a position corresponding to the entrance opening 18. Further, a sealing groove 19 is recessed behind the entrance opening 18 on the outer surface of the inner housing 11. The sealing groove 19 is formed over the entire periphery on the outer surface of the inner housing 11 while having a substantially constant opening width in the front-rear direction. As shown in FIG. 1, an annular seal ring 20 is fit and held in the sealing groove 19 of the inner housing 11.

A jaw portion 21 is provided between the entrance opening 18 and the sealing groove 19 on the outer surface of the inner housing 11. The front surface of the jaw portion 21 is arranged substantially along a vertical direction and has guide receiving portions 22 in the form of slit holes extending substantially along the vertical direction on both left and right sides as shown in FIG. 9. A lower end part of the jaw portion 21 is cut to be open without defining the front end of the sealing groove 19.

As shown in FIG. 7, a pair of fixing receiving portions 23 are recessed on upper and lower surfaces of a rear part of the outer surface of the inner housing 11. As shown in FIG. 8, the fixing receiving portion 23 is in the form of a shallow groove extending in a lateral direction.

Further, as shown in FIG. 1, the rear surface of the inner housing 11 is provided with an accommodation recess 24 open in this rear surface. The rear end of each cavity 13 is open in the back surface of the accommodation recess 24. A sealing member 25 is inserted into the accommodation recess 24 e.g. from behind.

The sealing member 25 is a one-piece rubber plug having a plurality of sealing holes 26 through which wires 100 to be described later are inserted in a liquid-tight manner, and the outer surface thereof is held in close contact with the inner surface of the accommodation recess 24 over the entire periphery. As shown in FIG. 1, the sealing member 25 is closely fit into a front part of the accommodation recess 24 and retained by a later-described pressing portion 27 of the outer housing 12 inserted into a rear part of the accommodation recess 24.

The terminal fitting 50 is integrally or unitarily formed such as by bending, folding and/or embossing a conductive metal plate and shaped to be long and narrow in the front-rear direction as a whole as shown in FIG. 1. This terminal fitting 50 includes a terminal body 51 substantially in the form of a rectangular tube penetrating in the front-rear direction), a wire connection portion connected behind the terminal body 51 (the wire connection portion particularly comprising at least one wire barrel 52 connected behind the terminal body 51 and an insulation barrel 53 connected behind the wire barrel 52). The wire connection portion is to be electrically and/or mechanically connected to a wire 100, wherein particularly the wire barrel 52 is to be crimped or deformed or folded and connected to a core portion 120 exposed by removing a coating 110 at an end part of the wire 100, and the insulation barrel 53 is crimped and connected to the coating 110 at the end part of the wire 100. An unillustrated resilient contact piece is deflectably and deformably provided inside the terminal body 51. As shown in FIG. 2, the male tab 93 of the mating terminal fitting 92 is inserted into the terminal body 51 to contact the resilient contact piece when the both housings 10, 90 are properly connected, whereby the both terminal fittings 50, 92 are electrically connected.

A lance receiving portion 54 is open in a lower part of a peripheral wall of the terminal body 51. The lance receiving portion 54 can be locked by the upper part 16 of the locking lance 15 inserted thereinto. An upright retainer receiving portion 55 extending substantially along the vertical direction is provided on the rear end of the terminal body 51. The retainer receiving portion 55 can be locked by a locking body 73 of a later-described retainer portion 69 of the front retainer 60.

Figure 10:
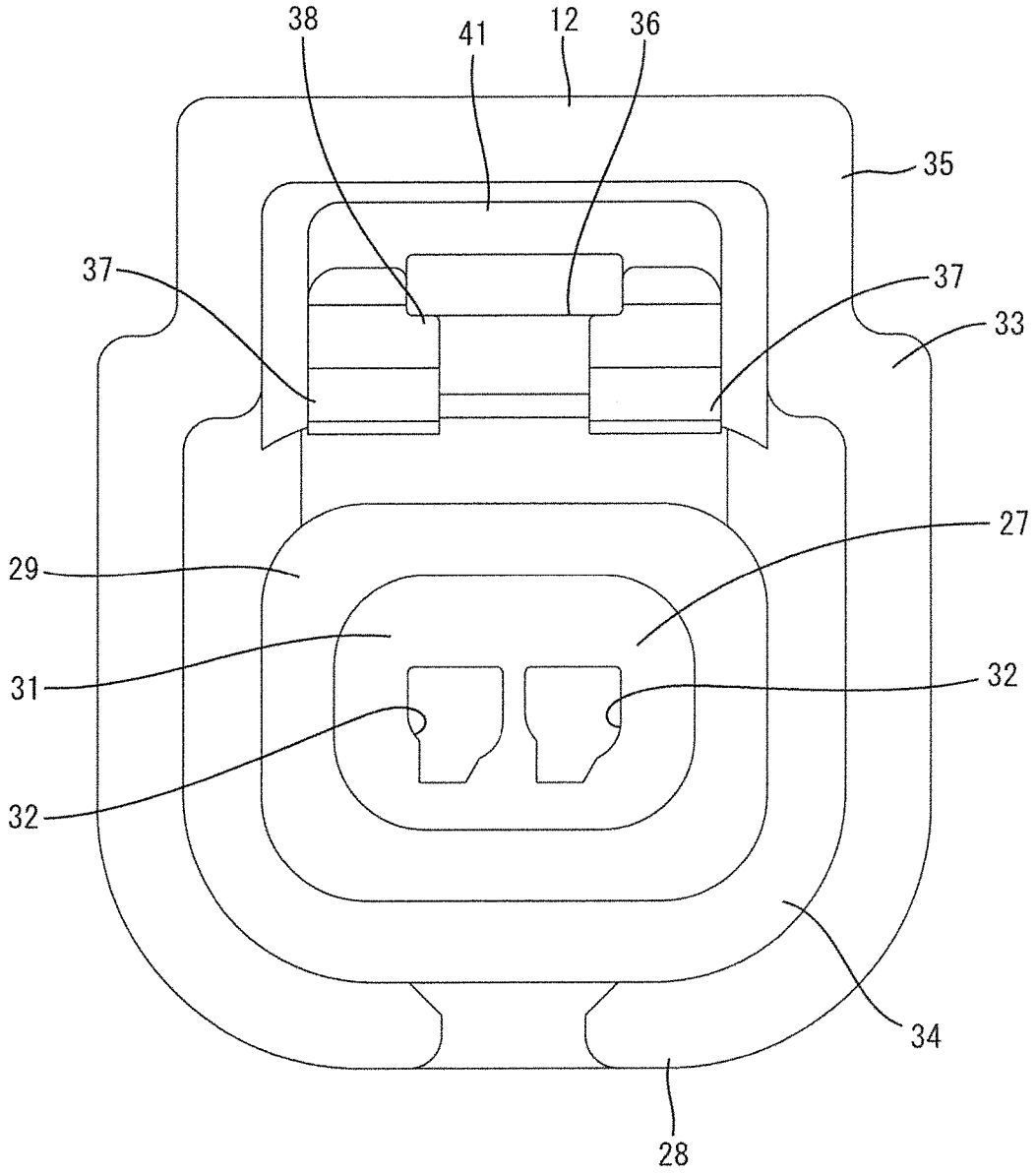
FIG. 10 is a front view of an outer housing.
Figure 11:
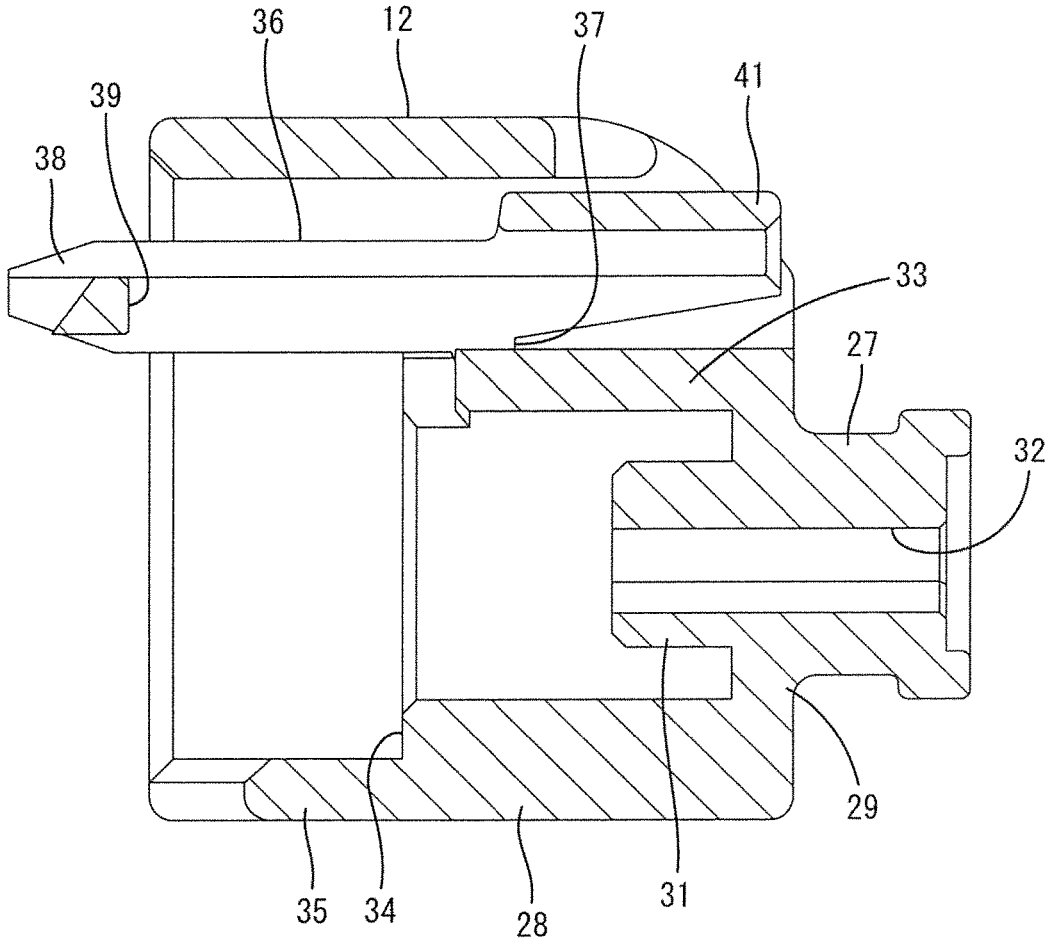
FIG. 11 is a side view in section of the outer housing.

As shown in FIGS. 10 and 11, the outer housing 12 includes the block-like pressing portion 27, a tubular outer tube portion 28 arranged radially outward of the pressing portion 27 and a radially extending linking portion 29 linking the outer tube portion 28 and the pressing portion 27. The pressing portion 27 includes a protruding portion 31 protruding further forward than a location coupled to the linking portion 29. As shown in FIG. 1, the protruding portion 31 is fittable into the rear part of the accommodation recess 24. Further, the pressing portion 27 is provided with a plurality of insertion holes 32 capable of communicating with the respective cavities 13 and the respective sealing holes 26 and penetrating in the front-rear direction. The wire 100 is inserted with a play in a radial direction into each insertion hole 32.

As shown in FIG. 11, the outer tube portion 28 is composed of or comprises a base portion 33 projecting further forward than a location coupled to the linking portion 29 and a surrounding portion 35 projecting forward from the front end of the base portion 33 and having an inner surface located outwardly of the inner surface of the base portion 33 via a stepped portion 34. As shown in FIG. 1, a rear part of the inner housing 11 is fit into the base portion 33 and a peripheral wall part of the accommodation recess 24 is sandwiched between the base portion 33 and the protruding portion 31.

A lock arm 36 is provided between the base portion 33 and the surrounding portion 35 in an outer portion (e.g. an upper part) of the outer housing 12. As shown in FIG. 11, the lock arm 36 includes a leg portion 37 rising from a front part of an upper wall of the base portion 33, and an arm portion 38 extending both forward and rearward from the upper end of the leg portion 37. The arm portion 38 can be resiliently displaced in a seesaw manner (tiltably displaceable) with the leg portion 37 substantially as a supporting point. The arm portion 38 is provided with a lock hole 39 extending in the front-rear direction and open on a rear end. The front end of the lock hole 39 is arranged substantially along the vertical direction. As shown in FIG. 2, the receptacle 91 of the mating housing 90 is externally fit to a front part of the inner housing 11 and the mating lock portion 94 is inserted into the lock hole 39 and arranged to be lockable to the front end of the lock hole 39, whereby the both housings 10, 90 are held in a connected state.

A front part (including the front end of the lock hole 39) of the arm portion 38 is arranged in an exposed manner before the front end of the surrounding portion 35. Further, a rear part of the arm portion 38 is arranged in an exposed manner behind the rear end of the surrounding portion 35. An unlocking portion 41 in the form of a flat plate is provided at a slightly higher position on the rear part of the arm portion 38. The upper surface of the unlocking portion 41 is pressed, whereby a locking state between the lock arm 36 and the mating lock portion 94 can be released.

Figure 12:
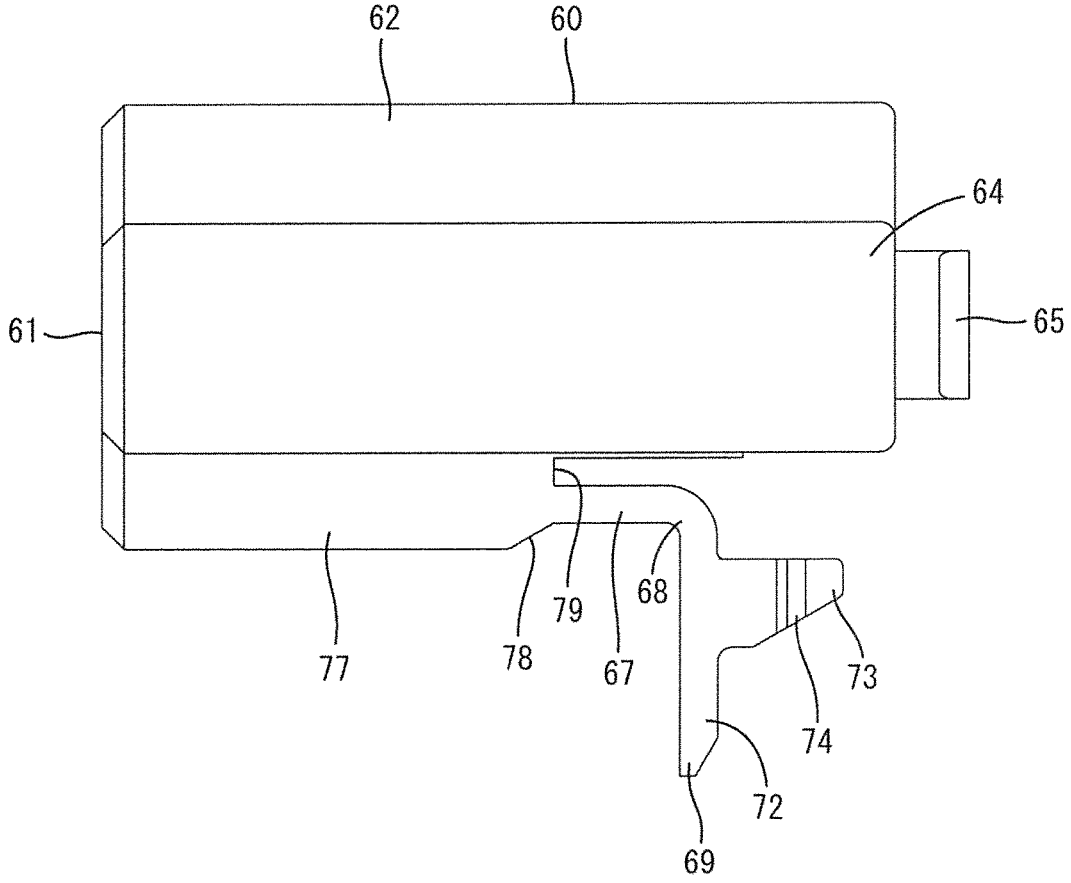
FIG. 12 is a side view of the front retainer with the retaining portion set in the opening state.
Figure 13:
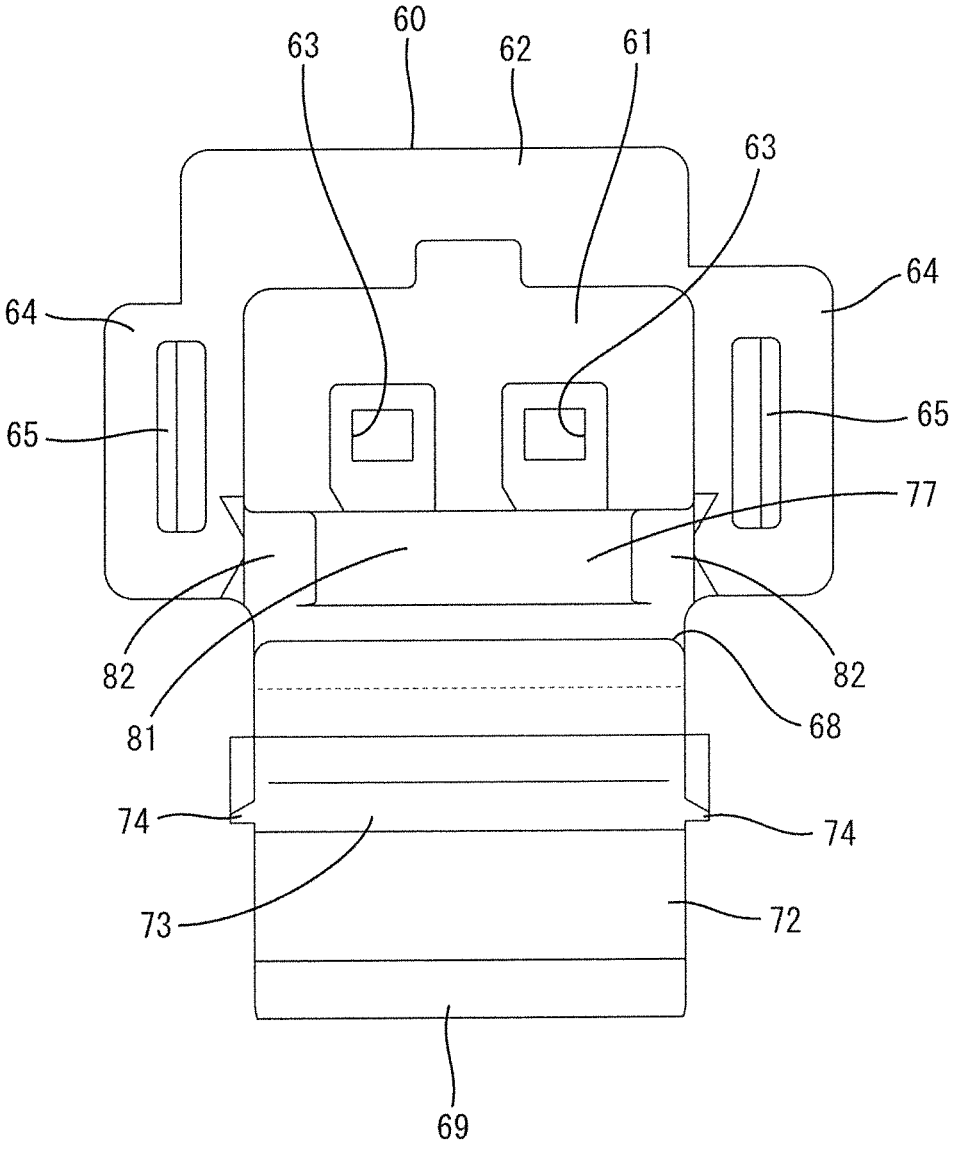
FIG. 13 is a back view of the front retainer with the retaining portion set in the opening state.
Figure 14:
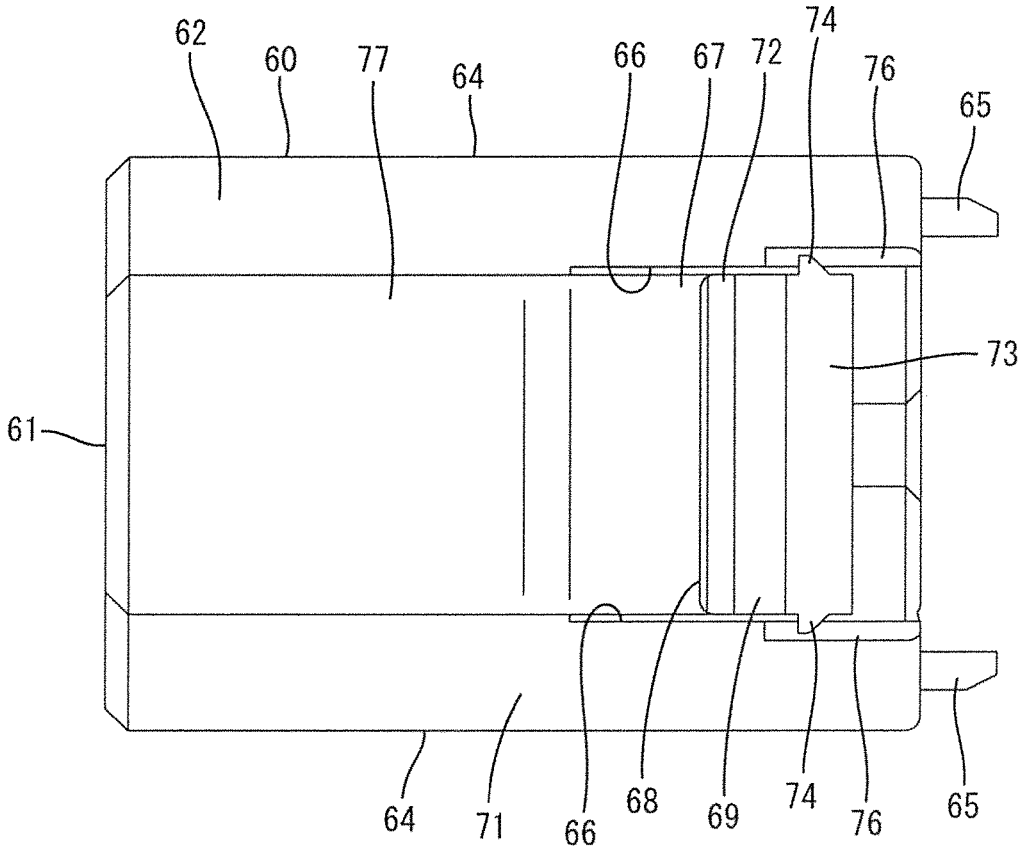
FIG. 14 is a bottom view of the front retainer with the retaining portion in the open state.

Next, the front retainer 60 is described. The front retainer 60 is made of synthetic resin, cap-shaped and includes, as shown in FIGS. 12 to 14, a front wall portion 61 extending substantially along the vertical direction and a tubular peripheral wall portion 62 projecting rearward from an outer peripheral part of the front wall portion 62. This front retainer 60 is movable from a partial locking position PLP where the front wall portion 61 is separated forward from the front surface of the inner housing 11 as shown in FIG. 1 to a full locking position FLP where the front wall portion 61 is arranged substantially in contact with the front surface of the inner housing 11 as shown in FIG. 2 with the peripheral wall portion 62 surrounding an outer peripheral side of the front part of the inner housing 11.

The front wall portion 61 is provided with a plurality of through holes 63 capable of communicating with the respective cavities 13. As shown in FIG. 2, a rear part of the through hole 63 is in the form of a recess having a large diameter and a front end part of the terminal body 51 of the terminal fitting 50 is fittable thereinto from behind. A front part of each through hole 63 is gradually widened toward the front, and the male tab 93 of the mating terminal fitting 92 can be guided thereinto from front.

As shown in FIGS. 13 and 14, a pair of guide portions 65 project on the rear ends of both side walls 64 of the peripheral wall portion 62. Each guide portion 65 is in the form of a plate piece extending substantially along the vertical direction.

As shown in FIG. 14, a pair of left and right slits 66 extending in the front-rear direction and open on a rear end are provided in a rear part of a lower wall 71 of the peripheral wall portion 62. A plate piece portion 67 arranged between the slits 66 in the lower wall 71 of the peripheral wall portion 62 includes a hinge 68 at an intermediate position in the front-rear direction (specifically, central part in the front-rear direction), and the retaining portion 69 behind the hinge 68. The hinge 68 is a substantially linear flexible part extending along the lateral direction and can be bent into a curved surface.

The retaining portion 69 is rotatable (tiltable) from an opening state (see FIG. 1) for opening the rear part of the lower wall 71 to a closing state CS (see FIG. 2) for substantially closing the rear part of the lower wall 71 via the hinge 68. As shown in FIG. 13, this retaining portion 69 includes a flat plate portion 72 connected to the hinge 68 while having the same width, and the locking body 73 projecting from an intermediate position of the flat plate portion 72 in the front-rear direction. The flat plate portion 72 is substantially in the form of a rectangular flat plate, and the inner surface (surface facing toward the cavities 13 in the closing state) of a rear end part (free end part) is formed into a slope facing outward.

The locking body 73 is in the form of a ridge projecting in a direction substantially perpendicular to a rotating direction of the retaining portion 69 toward the closing state CS and a plate surface direction of the flat plate portion 72 and extending over the entire width of the flat plate portion 72 in the lateral direction. When the retaining portion 69 is in the closing state CS, the rear surface of the locking body 73 is arranged to stand along the vertical direction.

Figure 3:
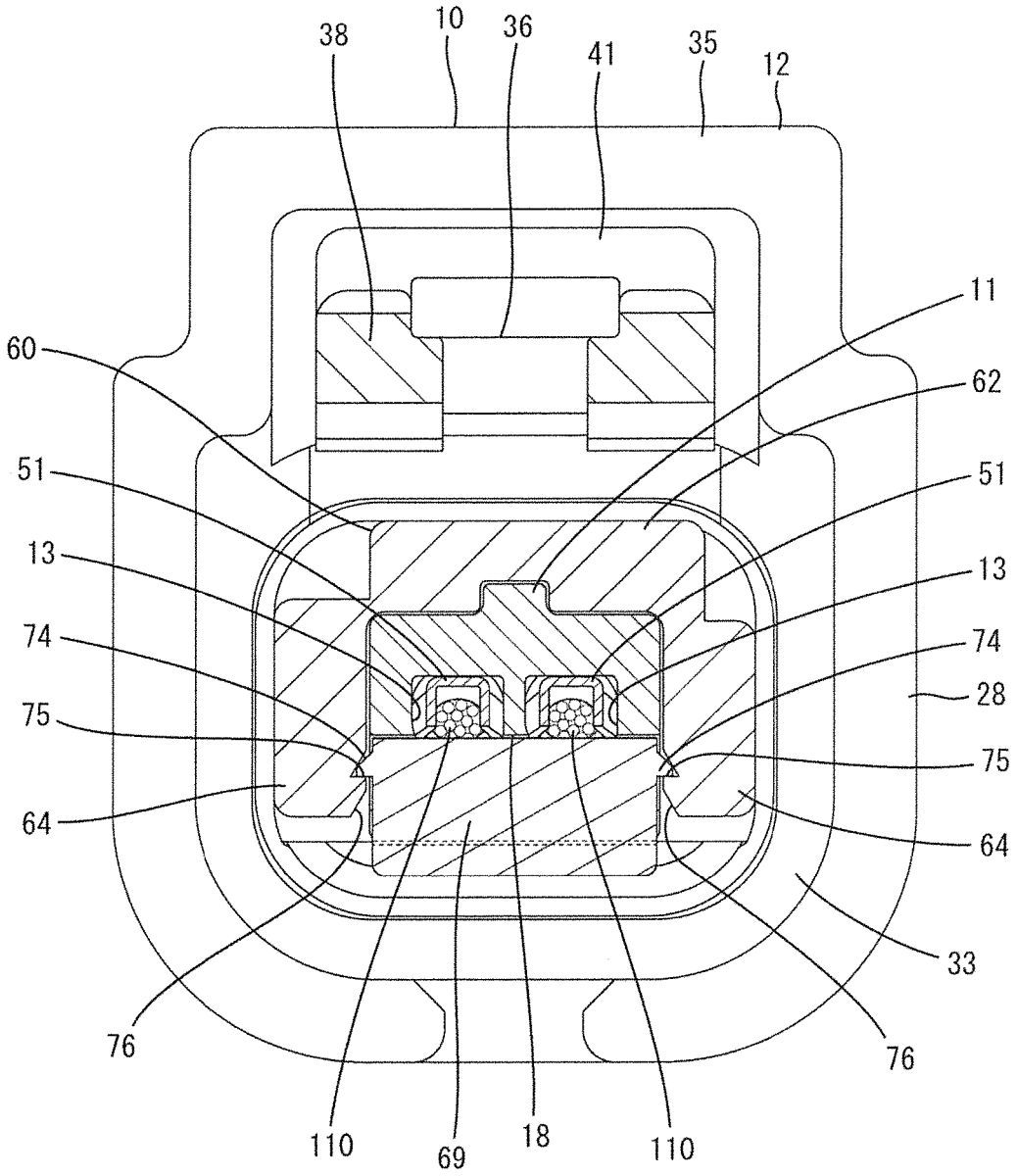
FIG. 3 is a front view in section when the front retainer is at the full locking position with respect to the housing and the retaining portion is closed.

A pair of lock portions 74 are provided at positions near a projecting tip on both side surfaces of the locking body 73. The respective lock portions 74 are in the form of ribs protruding toward both left and right sides of the plate piece portion 67 and extending in a direction parallel to the plate surface direction of the flat plate portion 72 on the locking body 73, particularly on the both side surfaces of the locking body 73. As shown in FIG. 3, when the retainer portion 69 is in the closing state CS, the upper surfaces of the respective lock portions 74 are inclined down and the lower surfaces thereof are arranged substantially horizontally.

As shown in FIG. 3, a pair of lock receiving portions 75 are provided on the inner surfaces of rear parts of the both side walls 64 of the peripheral wall portion 62. Each lock receiving portion 75 is in the form of a groove extending in the front-rear direction and open on a rear end and has the same cross-sectional shape as the lock portion 74. Further, the rear parts of the both side walls 64 are provided with a pair of slope portions 76 formed to gradually widen the rear parts from lower ends toward the respective lock portions 74. Each lock portion 74 slides on the slope portion 76 in the process of rotating toward the closing state and is fit and lockable to the corresponding lock receiving portion 75 in the closing state.

As shown in FIGS. 1 and 12, a deflection restricting portion 77 is provided in a front part of the lower wall 71 of the peripheral wall portion 62. The deflection restricting portion 77 is thicker than the plate piece portion 67 (part of the retainer portion 69 excluding the locking body 73) and connected to the front end of the plate piece portion 67 in a stepped manner. A rear surface lower part 78 of the deflection restricting portion 77 is formed into a slope inclined upward toward the plate piece portion 67, and a rear surface upper part 79 of the deflection restricting portion 77 is substantially perpendicular to the plate piece portion 67 along the vertical direction.

As shown in FIG. 1, the deflection restricting portion 77 includes a restricting body 81 inclined straight downward from the lower edges of the rear ends of the respective through holes 63 to the rear surface upper part 79. As shown in FIG. 13, the restricting body 81 is formed as a wide inclined surface extending in a range over the respective through holes 63 in the lateral direction. Further, the deflection restricting portion 77 includes a pair of sections 82 in the form of rectangular columns extending in the front-rear direction on both left and right sides of the restricting body 81. Each section 82 is coupled integrally or unitarily to each side wall 64 in the front-rear direction. As shown in FIG. 1, a recess 83 having a depth to reach the deflection restricting portion 77 is provided on the front surface of the front wall portion 61. An unillustrated tool for conduction inspection or the like is inserted into the recess 83.

Next, functions and effects of the connector of this embodiment are described.

In assembling, the sealing member 25 is fit into the front part of the accommodation recess 24 of the inner housing 11 and, further, the terminal fitting 50 with the wire 100 is inserted into each cavity 13 from behind. The upper part 16 of the locking lance 15 is resiliently fit to the lance receiving portion 54 of the terminal body 51 and lockably arranged, whereby the terminal fitting 50 is held while being prevented from coming out rearward from the cavity 13. Further, the outer housing 12 is externally fit to the inner housing 11 to fit the protruding portion 31 of the pressing portion 27 into the rear part of the accommodation recess 24. Unillustrated fixing portions of the outer housing 12 are locked to the respective fixing receiving portions 23 of the inner housing 11, whereby the outer housing 12 is externally fit and held on the inner housing 11.

Figure 4:
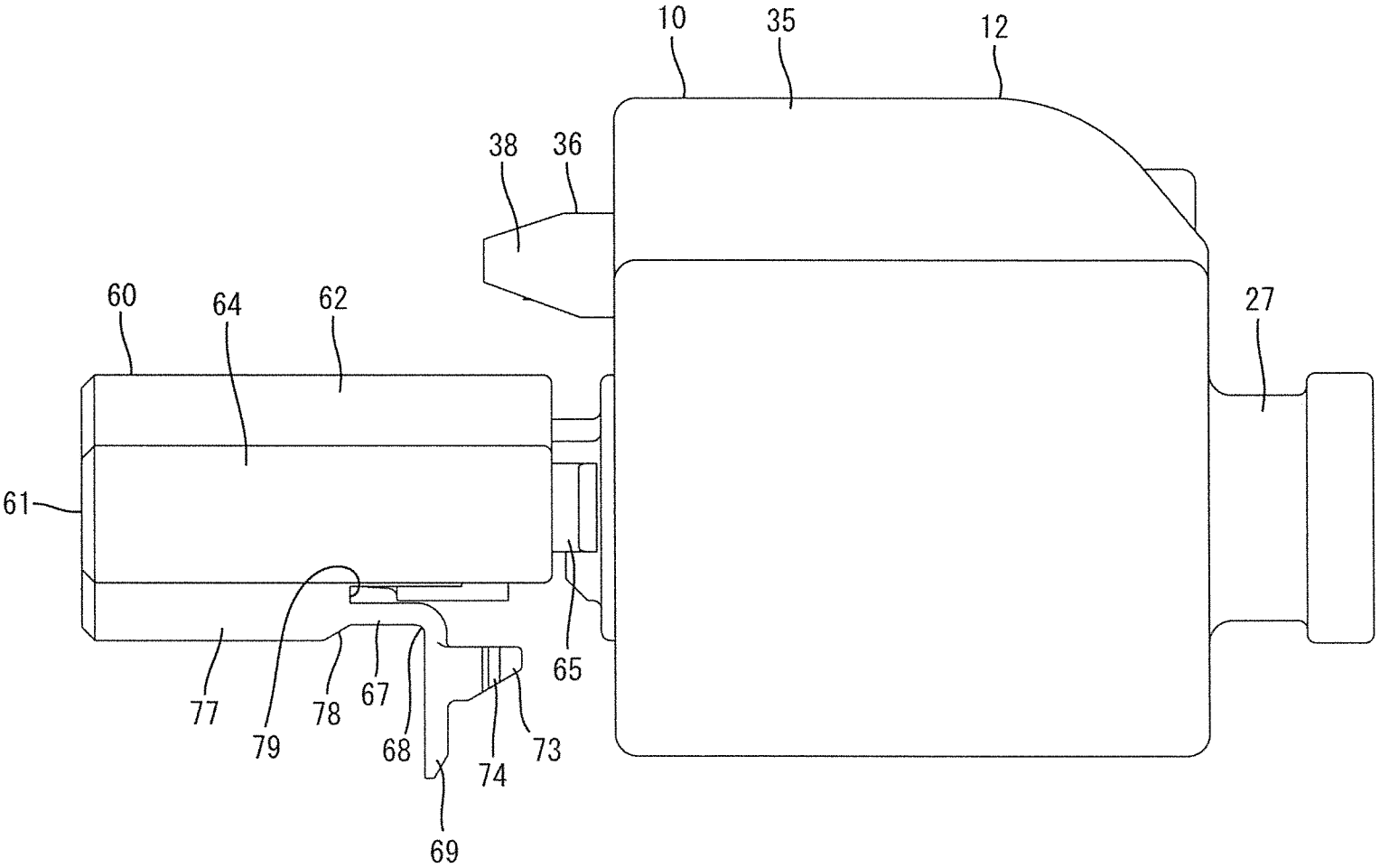
FIG. 4 is a side view when the front retainer is at the partial locking position with respect to the housing and the retaining portion is open.
Figure 5:
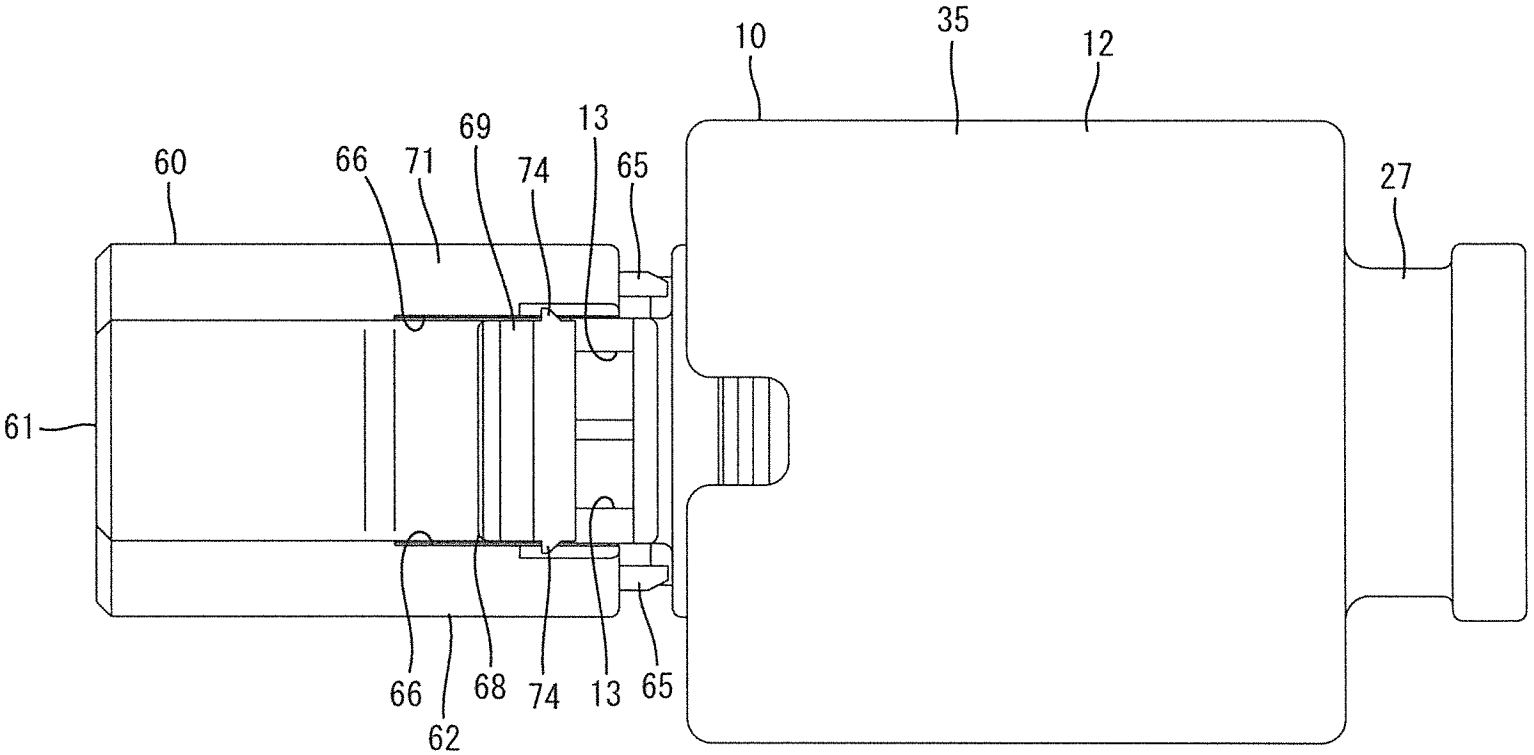
FIG. 5 is a bottom view when the front retainer is at the partial locking position with respect to the housing and the retaining portion is open.
Figure 6:
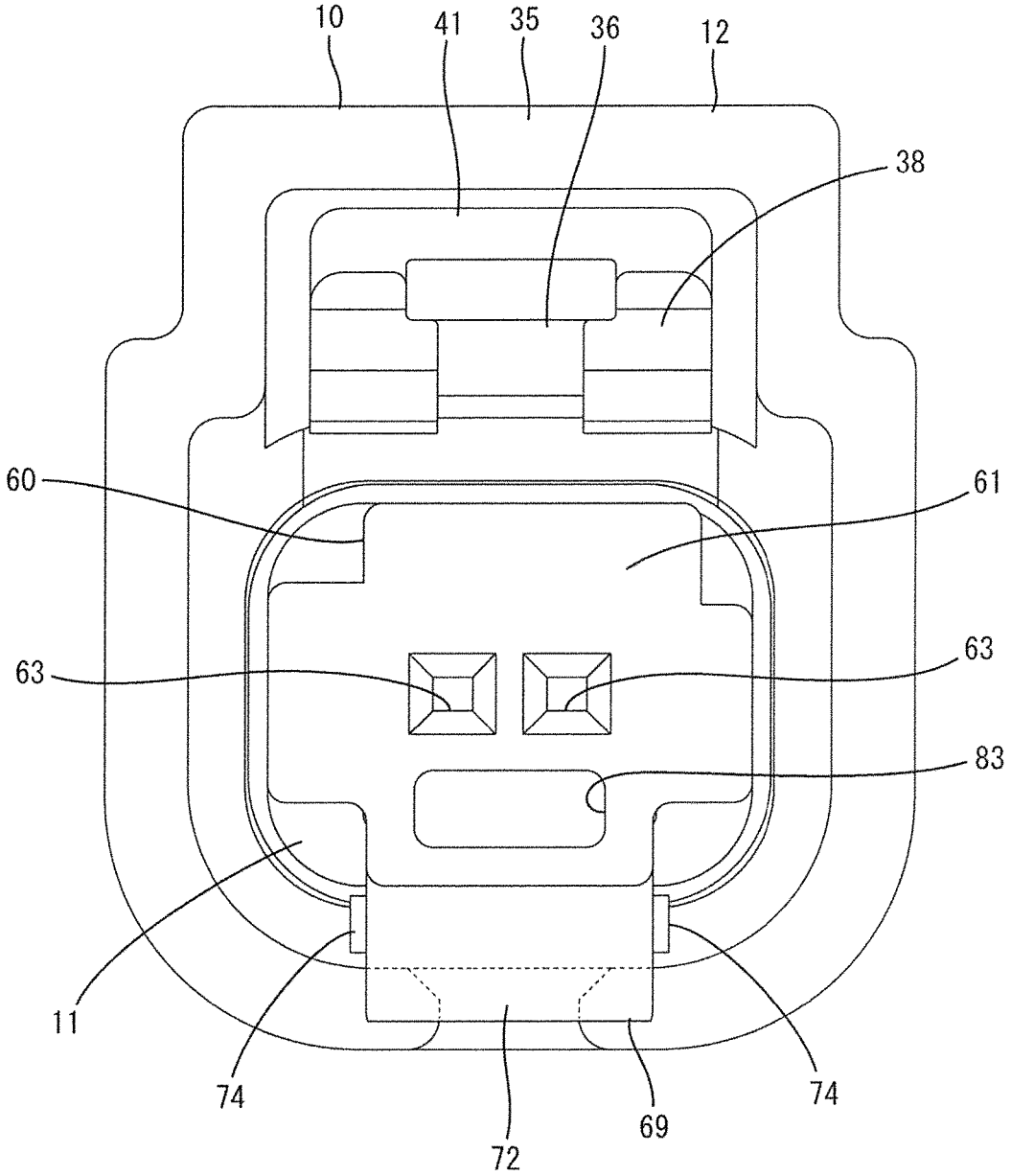
FIG. 6 is a front view when the front retainer is at the partial locking position with respect to the housing and the retaining portion is open.

Further, as shown in FIGS. 4 to 6, the front retainer 60 is held at the partial locking position PLP with respect to the inner housing 11. As shown in FIG. 1, at the partial locking position PLP, the restricting body 81 of the deflection restricting portion 77 is located in the opening 14 (deflection spaces for the locking lances 15) and the lower surfaces of the locking lances 15 are arranged along the restricting body 81. Further, at the full locking position FLP, the retainer portion 69 is in the opening state OS and arranged to hang in a down direction substantially perpendicular to the front-rear direction via the hinge portion 68.

If the terminal fitting 50 is left without being properly inserted into the cavity 13 (incompletely inserted state), the locking lance 15 is pressed by the terminal body 51 and kept deflected and deformed toward the opening 14. Thus, in the process of mounting the front retainer 60 at the partial locking position PLP with respect to the inner housing 11, the retaining portion 69 in the opening state OS contacts the deflected and deformed locking lance 15, thereby stopping a mounting operation of the front retainer 60. In this way, it can be detected in an early stage that the terminal fitting 50 is incompletely inserted.

Subsequently, the front retainer 60 is moved to the full locking position FLP. In the process of moving toward the full locking position FLP, each guide portion 65 is slidably fit into the facing guide receiving portion 22 to guide a movement of the front retainer 60. When the front retainer 60 reaches the full locking position FLP, the restricting body 81 is in contact along the lower surfaces of the locking lances 15 to restrict the deflection of the locking lances 15 as shown in FIG. 2. Then, the respective sections 82 are arranged laterally outward of the upper parts 16 of the respective locking lances 15. Further, the front end parts of the terminal bodies 51 are fit into the rear parts of the through holes 63 to be positioned.

Subsequently, the retaining portion 69 is displaced or tilted toward the closing state CS via the hinge 68. As shown in FIG. 2, in the closing state CS, the flat plate portion 72 is arranged substantially horizontally along the front-rear direction and the locking body 73 is arranged to stand substantially along the vertical direction. Further, in the closing state CS, the locking body 73 is inserted into each cavity 13 through the entrance opening 18 and arranged to be able to face and come into contact with (lock) the retainer receiving portion 55 of each terminal body 51. In this way, the terminal fittings 50 are reliably retained in the cavities 13.

Further, the rear end part (free end part) of the flat plate portion 72 is arranged to be able to come into contact with the front end of the seal ring 20 through an open part of the jaw portion 21. In this way, forward detachment of the seal ring 20 is restricted. Here, if the seal ring 20 is deviated forward from the sealing groove 19, the sloped part of the rear end part of the flat plate portion 72 presses the seal ring 20 in the process of rotating toward the closing state CS, whereby the seal ring 20 can be pushed back toward the sealing groove 19. Further, in the closing state CS, each lock portion 74 of the locking body 73 is fit and locked to the corresponding lock receiving portion 75 as shown in FIG. 3, thereby restricting a displacement of the locking body 73 in a direction to return to the closing state CS. Thereafter, the both housings 10, 90 are connected, the front part of the inner housing 11 and the front retainer 60 are inserted into the receptacle 91 and the male tabs 93 of the mating terminal fittings 92 are inserted into the terminal bodies 51 of the terminal fittings 50 for connection through the through holes 63.

As described above, according to this embodiment, the front retainer 60 includes the deflection restricting portion 77 for restricting the deflection of the locking lances 15 and, in addition, the retaining portion 69. By a displacement (particularly tilting movement) of the retainer portion 69 about the hinge portion 68 from the opening state OS to the closing state CS, the locking body 73 laterally locks the retainer receiving portions 55 and retains the terminal fittings 50. Thus, the terminal fittings 50 can be reliably prevented from coming out rearward from the cavities 13.

Further, since it is not necessary to provide a dedicated retainer member such as a side retainer separately from the front retainer 60, the number of components can be reduced. In addition, since the front retainer 60 is provided with the retaining portion 69, it can be prevented that the structure of the housing 10 becomes complicated. Particularly in the case of this embodiment, the inner housing 11 is provided with the entrance opening 18 penetrating from the lower surface to the respective cavities 13 and allowing the entrance of the locking body 73 of the retaining portion 69, and the seal ring 20 to be sandwiched between the inner housing 11 and the mating housing 90 is fit behind the entrance opening 18. Thus, the inner housing 11 has no marginal space to integrally or unitarily provide the retaining portion 69. Therefore, a merit of providing the front retainer 60 with the retaining portion 69 is large.

Further, the retaining portion 69 is provided on the lower wall 71 of the peripheral wall portion 62 on the same side as the deflection restricting portion 77 and, when the front retainer 60 is mounted in the opening state OS, the retaining portion 69 is arranged to substantially face the deflected and deformed locking lance 15. Thus, the retaining portion 69 in the opening state OS can lightly interfere with the deflected and deformed locking lance 15 earlier than the deflection restricting portion 77. As a result, it can be satisfactorily detected in an early stage that the locking lance 15 is deflected and deformed.

Furthermore, since the deflection restricting portion 77 is formed thicker than the hinge 68, the strength thereof can be ensured and, in addition, deflection strength of the hinge 68 can be reinforced.

Further, the retaining portion 69 particularly includes the one or more lock portions 74 projecting on the both side surfaces of the locking body 73 and the lock portions 74 lock the lock receiving portions 75 provided on the both side walls 64 of the front retainer 60 in the closing state CS. Thus, the retaining portion 69 can stably maintain the closing state.

Furthermore, the seal ring 20 to be sandwiched between the inner housing 11 and the mating housing 90 as a connection partner in a liquid-tight manner is fit on the inner housing 11, and the retainer portion 69 is arranged to be able to come into contact with the front end of the seal ring 20 in the closing state CS. Thus, forward detachment of the seal ring 20 can be reliably suppressed by the retaining portion 69.

Other embodiments of the invention are briefly described.

The terminal fitting may be such a male terminal that a male tab projects forward from a tubular terminal body. In this case, the housing may include a receptacle into which the male terminal body projects.

The terminal body may be formed into a hollow cylindrical shape.

The retainer portion may be such that the locking body enters the cavities to be lockable to the retainer receiving portions of the terminal fittings in the closing state. It is not a prerequisite of the closing state that the retainer portion closes the entire entrance opening.

The deflection restricting portion may be individually provided at a position corresponding to the retainer receiving portion of each terminal fitting.

REFERENCE SIGNS

10 . . . housing
11 . . . inner housing
12 . . . outer housing
13 . . . cavity
15 . . . locking lance
18 . . . entrance opening
20 . . . seal ring
36 . . . lock arm
50 . . . terminal fitting
51 . . . terminal body
54 . . . lance receiving portion
55 . . . retainer receiving portion
60 . . . front retainer
64 . . . side wall
68 . . . hinge
69 . . . retaining portion
74 . . . lock portion
75 . . . lock receiving portion
77 . . . deflection restricting portion
90 . . . mating housing

What is claimed is:

1. A connector, comprising:

at least one terminal fitting including a terminal body, a lance receiving portion and a retainer receiving portion being provided on the terminal body;

a housing including at least one cavity capable of at least partly accommodating the terminal fitting inserted therein and a locking lance deflectably and deformably projecting into the cavity and configured to resiliently lock the lance receiving portion and restrict detachment of the terminal fitting; and a front retainer to be mounted to the housing substantially from front and including at least one deflection restricting portion configured to restrict the deflection of the locking lance by at least partly entering a deflection space for the locking lance and a retaining portion configured to lock the retainer receiving portion and retain the terminal fitting by approaching the terminal fitting in a lateral direction intersecting a front-rear direction by a displacement about at least one hinge portion from an opening state to a closing state.

2. The connector of claim 1, wherein:

the housing comprises an inner housing including the cavity and configured such that the front retainer is mounted thereto, and an outer housing separate from the inner housing, at least partly located radially outward of the inner housing.

3. The connector of claim 2, wherein the outer housing includes a lock arm capable of holding a mating housing as a connection partner in a connected state.

4. The connector of claim 2, wherein the inner housing is provided with at least one entrance opening penetrating from an outer surface to the cavity and allowing the entrance of a locking body of the retaining portion, and at least one seal ring to be sandwiched between the inner housing and a mating housing in a fluid-tight manner is fit behind the entrance opening.

5. The connector of claim 1, wherein the retaining portion is provided on the substantially same side as the deflection restricting portion, and arranged to be able to substantially face the deflected and deformed locking lance in the opening state.

6. The connector of claim 1, wherein the deflection restricting portion is thicker than the hinge.

7. The connector of claim 1, wherein the retaining portion include locks on both side surfaces of a locking body and the locks engage lock receiving portions provided on both side walls of the front retainer in the closing state.

8. The connector of claim 1, wherein at least one seal ring to be sandwiched between the housing and a mating housing as a connection partner in a fluid-tight manner is fit on the housing, and the retainer portion is arranged to be able to come into contact with a front end of the seal ring in the closing state.

* * * * *